US009425002B2

(12) United States Patent
Seo et al.

(10) Patent No.: US 9,425,002 B2
(45) Date of Patent: Aug. 23, 2016

(54) CIRCUIT BREAKER

(71) Applicant: LSIS CO., LTD., Anyang-si, Gyeonggi-do (KR)

(72) Inventors: Jae Kwan Seo, Cheongju-si (KR); Seong Yeol Cho, Cheongju-si (KR)

(73) Assignee: LSIS CO., LTD., Anyang-Si (KR)

( * ) Notice: Subject to any disclaimer, the term of this patent is extended or adjusted under 35 U.S.C. 154(b) by 159 days.

(21) Appl. No.: 13/929,512

(22) Filed: Jun. 27, 2013

(65) Prior Publication Data

US 2014/0008190 A1 Jan. 9, 2014

(30) Foreign Application Priority Data

Jul. 9, 2012 (KR) ..... 10-2012-0074703

(51) Int. Cl.

| | |
|---|---|
| ***H01H 9/02*** | (2006.01) |
| ***H01H 9/30*** | (2006.01) |
| ***H01H 1/22*** | (2006.01) |
| *H01H 1/64* | (2006.01) |
| *H01H 71/02* | (2006.01) |

(52) U.S. Cl.

CPC ..... *H01H 9/02* (2013.01); *H01H 1/226* (2013.01); *H01H 9/30* (2013.01); *H01H 1/64* (2013.01); *H01H 71/02* (2013.01); *H01H 2009/305* (2013.01)

(58) Field of Classification Search

CPC ..... H01H 9/02; H01H 9/00
USPC ..... 200/293
See application file for complete search history.

(56) References Cited

U.S. PATENT DOCUMENTS

| | | | |
|---|---|---|---|
| 4,716,265 | A | 12/1987 | Fujii et al. |
| 5,899,323 | A | 5/1999 | Rakus |

FOREIGN PATENT DOCUMENTS

| | | |
|---|---|---|
| CN | 1707720 | 12/2005 |
| CN | 1835164 | 9/2006 |
| CN | 101083186 | 12/2007 |
| EP | 1605483 | 12/2005 |
| EP | 1858041 | 11/2007 |
| EP | 2398033 | 12/2011 |
| JP | 2006-294511 | 10/2006 |
| KR | 10-2006-0048263 | 5/2006 |

OTHER PUBLICATIONS

Korean Intellectual Property Office Application Serial No. 10-2012-0074703, Office Action dated Jun. 19, 2013, 3 pages.
European Patent Office Application Serial No. 13174611.7, Search Report dated Oct. 11, 2013, 8 pages.
The State Intellectual Property Office of the People's Republic of China Application Serial No. 201310286908.9, Office Action dated Jan. 23, 2015, 8 pages.

*Primary Examiner* — Edwin A. Leon
*Assistant Examiner* — Iman Malakooti
(74) *Attorney, Agent, or Firm* — Lee Hong Degerman Kang & Waimey; Jonathan Kang; Jeffrey Lotspeich

(57) ABSTRACT

A circuit breaker includes: a housing; a stator accommodated in the housing and connected to a terminal unit; a mover selectively brought into contact with the stator; an opening and closing unit manipulating the mover such that the mover is selectively brought into contact with the stator; and an insulating cover provided in the housing and shielding the mover and the stator from the exterior of the housing, wherein the housing or the insulating cover is made by molding an electrical insulating material.

6 Claims, 6 Drawing Sheets

CIRCUIT BREAKER

CROSS-REFERENCE TO RELATED APPLICATION

Pursuant to 35, U.S.C. §119(a), this application claims the benefit of earlier filing date and right of priority to Korean Application No. 10-2012-0074703, filed on Jul. 9, 2012, the contents of which is incorporated by reference herein in its entirety.

BACKGROUND OF THE INVENTION

1. Field of the Invention

The present disclosure relates to a circuit breaker having an insulating cover.

2. Background of the Invention

In general, a circuit breaker refers to a device for opening and closing a load device or interrupting a current in the event of an accident such as earthing, short-circuit, or the like, in a transmission & sub-station system or an electrical circuit. Also, a circuit breaker, in which a circuit breaking part is insulated by an insulator and assembled, may generally manually open or close a line in use or may open or close it from a remote area through an electrical manipulator, or the like, outside a metal container. Also, in the event of overload or short-circuit, the circuit breaker automatically cuts off the line to protect an electric power system and a load device.

A circuit breaker may be classified into an air operation method, a hydraulic operating method, a spring operation method, and the like according to the way in which a circuit breaking part is operated. A circuit breaker may also be classified into an air circuit breaker (ACB) that extinguishes arc by blowing air, a gas circuit breaker (GCB) that extinguishes arc by blowing gas, and the like, according to the way in which arc generated when a mover is separated from a stator by manipulating a circuit breaking part is extinguished.

In order to cut off an electric circuit as mentioned above, a stator and a mover are installed in a circuit breaking part of a circuit breaker. The stator and the mover are usually in contact to allow a current to flow therethrough, and when a large current flows due to a fault generated in somewhere of the line, the mover is rapidly separated from the stator to interrupt current.

In the related art circuit breaker, when an overcurrent or a fault current occurs, an operating part rotates a mover to separate it from a stator. The operating part also includes a shaft assembly made of a metal. The shaft assembly is connected to the mover through a link structure. A housing accommodating the mover, or the like, has a hole in which the link structure is inserted and operated.

When the mover is separated from the stator, a high temperature high pressure arc is generated from a contact between the mover and the stator, and due to the high temperature high pressure arc, a metal component such as the shaft assembly, or the like, may be melted and leaked to the outside through the hole formed in the housing. In this case, phase-to-phase insulation may be weakened by the molten metal residue.

Meanwhile, when the shaft assembly of the related art breaker is made of plastic, a size of the circuit breaker may be increased.

SUMMARY OF THE INVENTION

Therefore, an aspect of the detailed description is to provide a circuit breaker where it is prevented that a component thereof is molten and leaked out due to high temperature heat resulting from a generation of arc according to separation of a mover and a stator.

To achieve these and other advantages and in accordance with the purpose of this specification, as embodied and broadly described herein, a circuit breaker includes: a housing; a stator accommodated in the housing and connected to a terminal unit; a mover selectively brought into contact with the stator; an opening and closing unit manipulating the mover such that the mover is selectively brought into contact with the stator; and an insulating cover provided in the housing and shielding the mover and the stator from the exterior of the housing, wherein the housing or the insulating cover is made by molding an electrical insulating material.

According to an embodiment of the present invention, a phenomenon in which a metal component within the circuit breaker is melted due to an arc generated as a mover and a stator are separated, and the molten metal residue is leaked to the outside to degrade insulating function of the circuit breaker can be prevented.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Hereinafter, a circuit breaker according to an embodiment of the present invention will be described in detail with reference to the accompanying drawings. In the following description, usage of suffixes such as 'module', 'part' or 'unit' used for referring to elements is given merely to facilitate explanation of the present invention, without having any significant meaning by itself.

Figure 1:
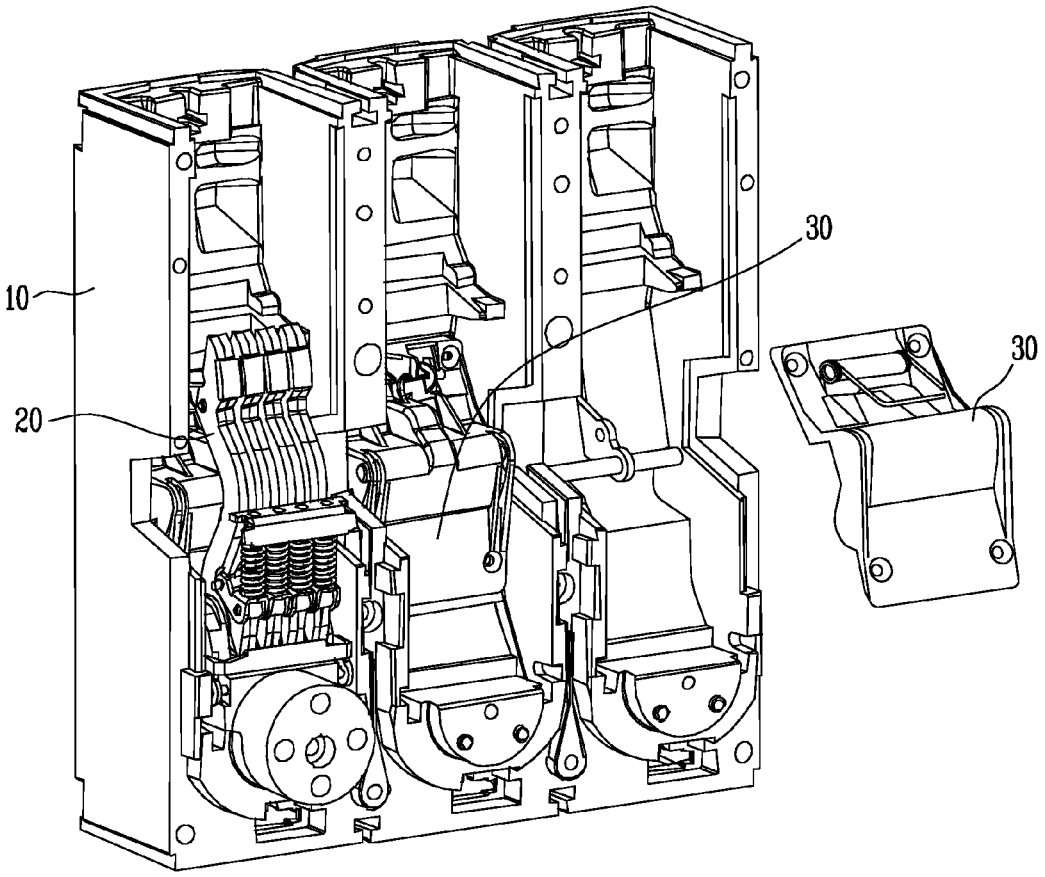
FIG. 1 is a view illustrating a circuit breaker according to an embodiment of the present invention.
Figure 2:
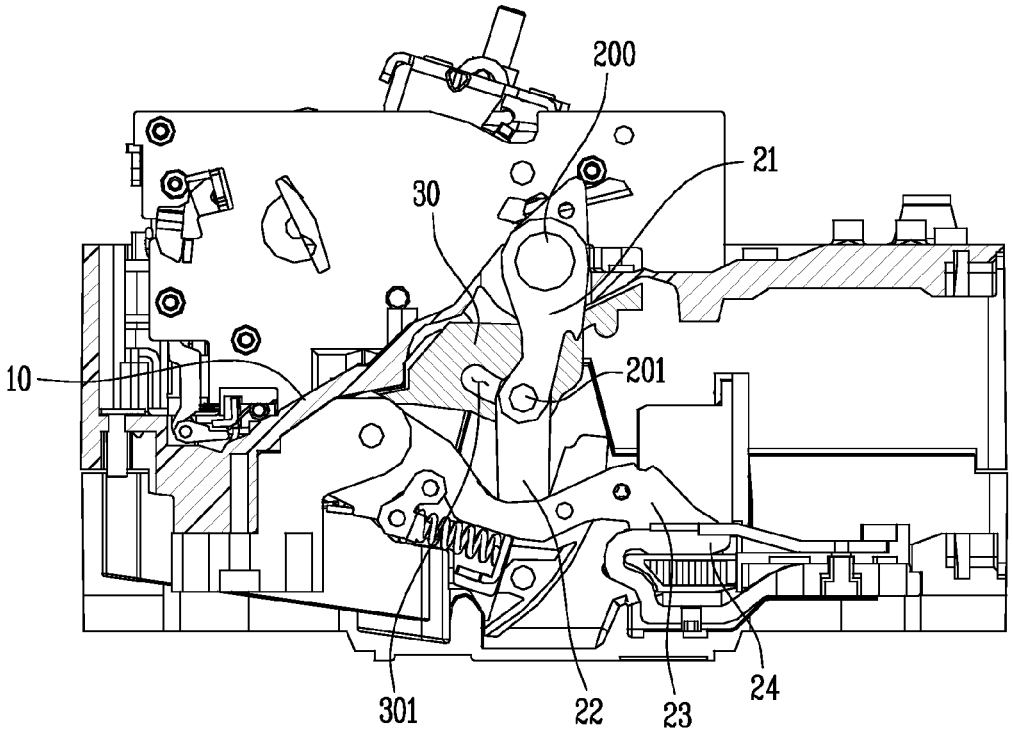
FIG. 2 is a partially cut-out view of the circuit breaker according to an embodiment of the present invention.

FIG. 1 is a view illustrating a circuit breaker according to an embodiment of the present invention, and FIG. 2 is a partially cut-out view of the circuit breaker according to an embodiment of the present invention.

Referring to FIGS. 1 and 2, a circuit breaker according to an embodiment of the present invention includes a housing 10, a mover assembly 20, and an insulating cover 30. The mover assembly 20 and the insulating cover 30 may be accommodated in the housing 10. A stator 24 connected to a terminal unit may be provided in the housing 10. The housing 10 may be fabricated by molding an electrical insulator.

The mover assembly 20 includes a mover 23 that may be brought into contact with the stator 24. In a normal state, the mover 23 is maintained in a state of being in contact with the stator 24, and when an overcurrent or a fault current is generated, the mover 23 rotates about a rotational shaft (by being centered thereon) so as to be separated from the stator 24. A state in which the mover 23 is in contact with the stator 24 to allow a current therethrough may be an ON state, and a state in which the mover 23 and the stator 24 are separated to prevent a current to flow therethrough may be an OFF state.

An opening and closing unit for manipulating the mover 23 to an ON position or an OFF position is provided in the housing 10. For example, the opening and closing unit includes a link 21 and a latch 22. The link 21 may be connected to a power transmission unit (not shown) by a first shaft 200. For example, the power transmission unit may be a handle. When an overcurrent or a fault current is generated, the link 21 connected to the other portion of the first shaft 200 may be rotated by manipulating the handle connected to one portion of the first shaft 200. The power transmission unit is not limited to the example of the handle. The power transmission unit may serve to transmit power to the first shaft 200 upon receiving external power.

The link 21 and the latch 22 may be connected by the second shaft 201. The latch 22 may be rotatably connected to the second shaft 201. Thus, the latch 2 may be manipulated according to a rotation of the link 21. According to a movement of the latch 22, the mover 23 may be manipulated to move to an ON or OFF position.

As the structure in which the mover 23 is turned on or off by the opening and closing unit, a conventional structure may be applied, so a detailed description thereof will be omitted. The first shaft 200, the second shaft 201, the link 21, the latch 22, and the like, may be made of a metal.

The insulating cover 30 may be installed in one surface of the housing 10. In detail, the insulating cover 30 shields the first shaft 200 in which the link 20 is installed and the power transmission unit (not shown), and the like, against a contact point between the mover 23 and the stator 24. Thus, a molten residue of the first shaft 200, or the like, due to an arc that may be generated from a contact point between the mover 23 and the stator 24 is prevented from being leaked to an outer side of the housing 10.

Hereinafter, a structure of the insulating cover 30 will be described. The insulating cover 30 may be fabricated by molding an electrical insulator.

Figure 3:
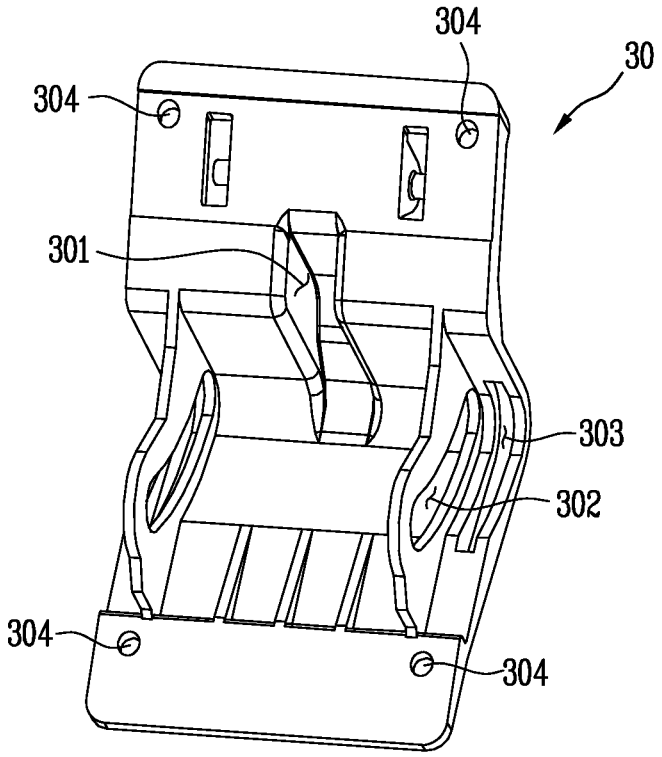
FIG. 3 is a view illustrating an insulating cover according to an embodiment of the present invention.

FIG. 3 is a view illustrating an insulating cover according to an embodiment of the present invention.

Referring to FIG. 3, the insulating cover 30 according to an embodiment of the present invention includes a link accommodation portion 301, a shaft insertion hole 302, and a latch insertion hole 303. As illustrated in FIG. 3, the insulating cover 30 may be coupled to the housing 10 such that one surface thereof is in contact with one surface of the housing 10.

The link accommodation portion 301 may be formed in consideration of a size and an operation range of the link 21 such that the link 21 is accommodated and operated therein. The link accommodation portion 301 may be formed as a recess. The link accommodation portion 301 may be formed as a recess having a size sufficient for the link 21 to operate without being interrupted. Since the link accommodation portion 301 is provided as a recess, rather than being open, although a molten residue is generated due to an arc within the insulating cover 30, leakage of the molten residue to the outside is prevented.

The latch 22 may be inserted into the latch insertion hole 303 and movable therein. The latch insertion holes 303 may be provided as openings are formed in both sides of the insulating cover 30.

Also, the second shaft 201, to which the latch 22 is connected, may be movably inserted into the shaft insertion hole 302. The shaft insertion hole 302 may be formed as a portion of an extending surface protruded from a portion of the insulating cover 30 is opened. The shaft insertion holes 302 may be formed in both sides of the insulating cover 30 such that they correspond to the positions of the latch insertion holes 303.

The latch insertion hole 303 and the shaft insertion hole 302 may be formed in consideration of operational coverage of the latch 22 and the second shaft 20, respectively. Namely, the latch insertion hole 303 and the shaft insertion hole 302 may be formed to be open to have a size with which operations of the latch 22 and the second shaft 201 are not interfered.

Meanwhile, a surface in which the latch insertion hole 303 is formed and a surface in which the shaft insertion hole 302 is formed may be perpendicular to each other. Since the shaft insertion hole 302 and the latch insertion hole 303 are formed not to be positioned on the same plane, a metal residue molten within the insulating cover 30 is prevented from being leaked to the outside through the shaft insertion hole 302 and the latch insertion hole 303.

The insulating cover 30 may include a plurality of fastening member insertion holes 304, and holes (not shown) corresponding to the fastening member insertion holes 304 may be formed in the housing 10. The insulating cover 30 may be coupled to the housing 10 by fastening members penetrating the fastening member insertion holes 304 and the holes (not shown) formed in the housing 10.

Figure 4:
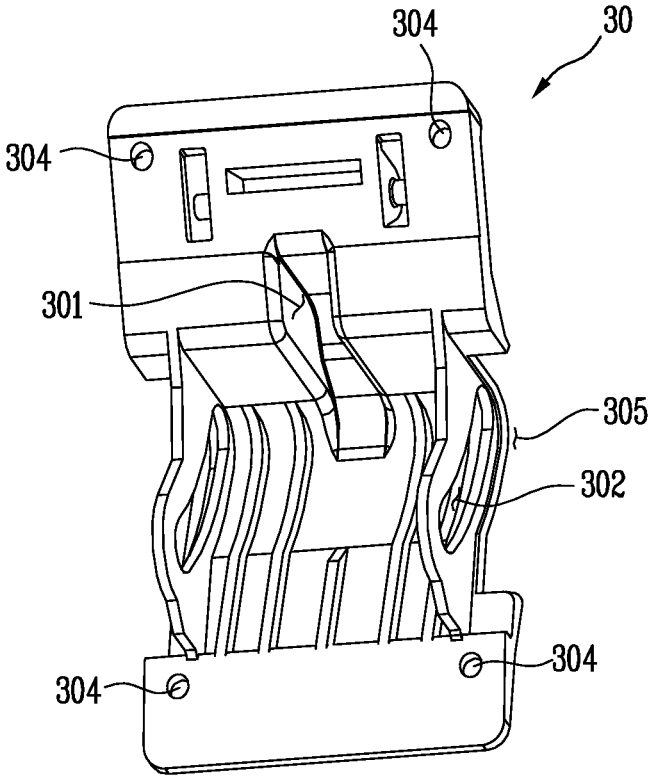
FIG. 4 is a view illustrating an insulating cover according to another embodiment of the present invention.

FIG. 4 is a view illustrating an insulating cover according to another embodiment of the present invention.

Referring to FIG. 4, the insulating cover 30 according to another embodiment of the present invention includes the link accommodation portion 301 and the shaft insertion hole 302. The insulating cover 30 may be coupled to the housing 10 such that one surface thereof is in contact with one surface of the housing 10.

The link accommodation portion 301 may be formed in consideration of a size and an operation range of the link 21 such that the link 21 is accommodated and operated therein. The link accommodation portion 301 may be formed as a recess.

The second shaft 201, to which the latch 22 is connected, may be movably inserted into the shaft insertion hole 302. The latch insertion hole 303 and the shaft insertion hole 302 may be formed in consideration of operational coverage of the second shaft 20. Namely, the shaft insertion hole 302 may be formed to be open to have a size with which operations of the latch 22 and the second shaft 201 are not interfered.

Meanwhile, a latch accommodation portion 305 may be formed in one side of the insulating cover 30 to allow the latch 22 to be positioned and operated therein. The latch accommodation portion 305 may be formed by cutting away a portion of the insulating cover 30 such that it is sufficient for the latch 22 to move therein.

The surface in which the latch accommodation portion 305 is formed may be at a right angle to the surface in which the shaft insertion hole 302 is formed. Since the shaft insertion hole 302 and the latch accommodation portion 305 are formed such that they are not connected parallelly, a molten metal residue within the insulating cover 30 is prevented from being leaked to the outside through the shaft insertion hole 302 and the latch accommodation portion 305.

The insulating cover 30 may include a plurality of fastening member insertion holes 304, and holes (not shown) corresponding to the fastening member insertion holes 304 may be formed in the housing 10. The insulating cover 30 may be coupled to the housing 10 by fastening members penetrating the fastening member insertion holes 304 and the holes (not shown) formed in the housing 10.

However, the shape of the insulating cover 30 is not limited to the foregoing embodiment. The insulating cover 30 may have any shape as long as it has a structure preventing a molten residue due to an arc, which may be generated as the mover 23 and the stator 24 are separated, from being leaked to the outside.

Figure 5:
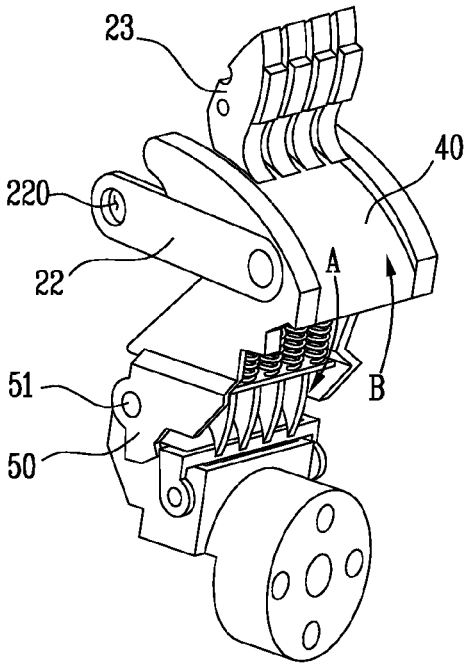
FIG. 5 is a view illustrating a mover assembly according to an embodiment of the present invention.

FIG. 5 is a view illustrating a mover assembly according to an embodiment of the present invention.

Referring to FIG. 5, a mover assembly according to an embodiment of the present invention includes the mover 23, a holder 40, and a bracket 50. The holder 40 and the bracket 50 are connected to the latch 22. In detail, a shaft (not shown) penetrating through the holder 40 and the bracket 50 may be connected to the latch 22. The holder 40 and the bracket 50 may be operated in direction 'A' or 'B' by the latch 22. The holder 40 and the bracket 50 may be operated in direction 'A' or 'B' by the latch 22 together with the mover 23. With the presence of the holder 40, the mover 23 can be brought into contact with the stator 24 without wobbling, and contact pressure is provided to the mover 23 to allow the mover 23 to be stably brought into contact with the stator 24.

Figure 6:
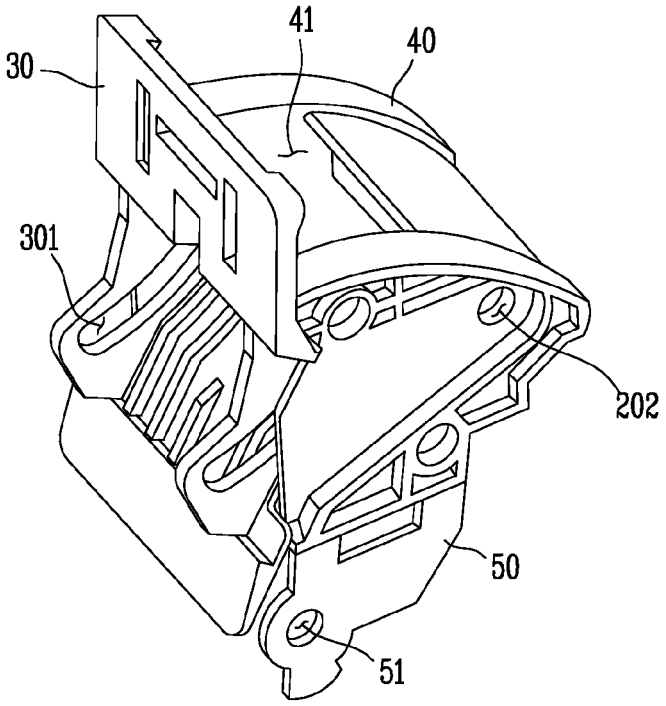
FIG. 6 is a view illustrating a coupled state of an insulating cover and a holder according to an embodiment of the present invention.
Figure 7:
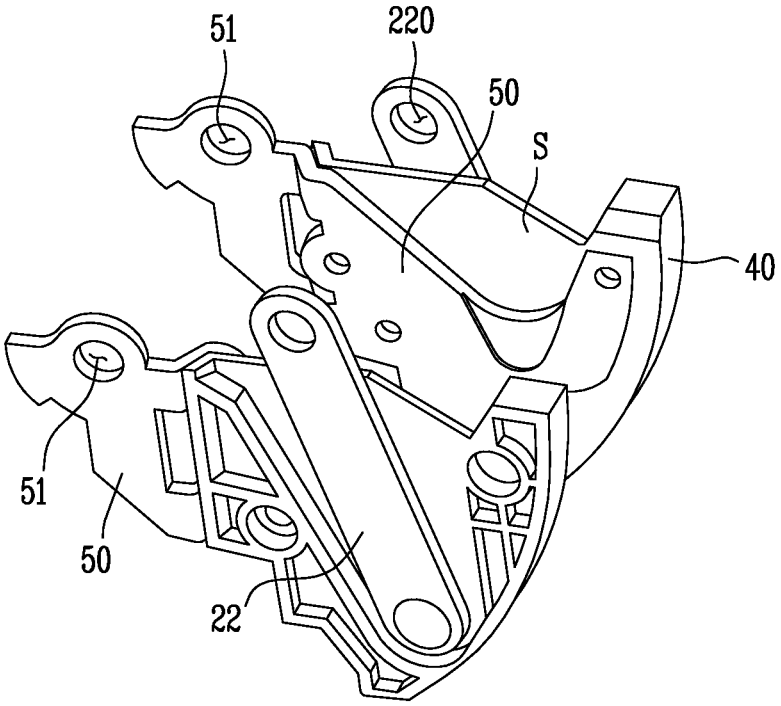
FIG. 7 is a view illustrating a coupled state of a bracket and the holder according to an embodiment of the present invention.

FIG. 6 is a view illustrating a coupled state of an insulating cover and a holder according to an embodiment of the present invention, and FIG. 7 is a view illustrating a coupled state of a bracket and the holder according to an embodiment of the present invention.

Referring to FIGS. 6 and 7, the bracket 50 may be provided to be in contact with an inner surface of the holder 40. The bracket 50 may be provided to be in contact with both inner surfaces of the holder 40 opposing thereto. Holes 202 are formed on the bracket 50 and the holder 40 in a connected manner. A shaft (not shown) connected to the latch 22 may be inserted into the hole 202.

A hole 41 allowing the mover 23 to be inserted therein may be formed in the holder 40. One side of the holder 40 may be positioned to be in contact with the insulating cover 30. When the holder 40 is moved in the direction 'B', it may come into contact with the insulating cover 30.

The bracket 50 may be formed to extend downwardly from the holder 40. A hole 51 is formed in the extending portion. A pin (not shown) may be inserted into the hole 51. The pin (not shown) may connect two brackets 50 positioned to be in contact with both inner surfaces of the holder 40.

The side of the holder 40 may extend to the insulating cover 30, rather than to the bracket 50. Both sides of the holder 40 may extend to the insulating cover 30, so when viewed from the inner side of the bracket 50, the holder 40 may be protruded toward the insulating cover 30 so as to be formed as large as the area 'S' relative to the bracket 50. The holder 40 may be formed such that a portion of the side thereof overlaps with a portion of an outer side of the insulating cover 30. Since both sides of the holder 40 further extend toward the insulating cover 30, relative to the bracket 50, a residue, or the like, due to an arc generation is prevented from being introduced to the interior of the circuit breaker through a space between the bracket 50 and the insulating cover 30. Since the introduction of the residue, or the like, to the interior of the circuit breaker is prevented, insulating performance of the circuit breaker can be enhanced.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A circuit breaker comprising:

a housing;

a stator accommodated in the housing and connected to a terminal unit;

a mover that pivots about an axis to be selectively brought into contact with the stator;

an opening and closing unit manipulating the mover such that the mover is selectively brought into contact with the stator, wherein the opening and closing unit comprises: a first shaft connected to a power transmission unit, a link connected to the first shaft, a second shaft connected to the link, and a latch having a first end and a second end, wherein the first end of the latch is connected to the link by the second shaft;

an insulating cover provided between the mover and the opening and closing unit, and shielding the mover and the stator from the exterior of the housing; and a holder connected to the second end of the latch, wherein the holder is movable about an axis in opposing first and second directions according to rotation of the first shaft, wherein the holder provides a contact force to the mover to cause the mover to pivot about the axis, wherein the axis of the holder is different than the axis of the mover;

wherein the housing or the insulating cover is made by molding an electrical insulating material, wherein, a part of the insulating cover is inserted into the holder such that a side of the holder is formed to overlap with a portion of a side of the insulating cover.

2. The circuit breaker of claim 1, wherein the insulating cover includes a link accommodation portion for accommodating the link.

3. The circuit breaker of claim 1, wherein an extending surface is formed on a portion of the insulating cover, and a shaft insertion hole is formed in the extending surface to allow the second shaft to be inserted thereinto and movable therein.

4. The circuit breaker of claim 1, wherein latch insertion holes are formed in both sides of the insulating cover to allow the latch to be inserted thereinto and movable therein.

5. The circuit breaker of claim 4, wherein both sides of the insulating cover to form the latch accommodation portion.

6. The circuit breaker of claim 1, wherein the holder has a hole to allow the mover to be inserted thereinto.

* * * * *